US005979650A

United States Patent [19]

Dull

[11] Patent Number: 5,979,650

[45] Date of Patent: Nov. 9, 1999

[54] EASILY REMOVED SLEEVE AND BULK CONTAINERS AND METHOD INCORPORATING SAME

[75] Inventor: Bob J. Dull, O'Fallon, Ill.

[73] Assignee: Bunge Foods, Bradley, Ill.

[21] Appl. No.: 09/028,211

[22] Filed: Feb. 23, 1998

[51] Int. Cl.[6] ..... B65D 25/14

[52] U.S. Cl. ..... 206/447; 493/94; 493/907; 53/175; 53/381.4

[58] Field of Search ..... 220/495.01, 495.06; 206/447; 493/94, 93, 100, 907, 906; 53/175, 170, 480, 481, 482, 483, 485, 492, 381.4, 291

[56] References Cited

U.S. PATENT DOCUMENTS

| | | | |
|---|---|---|---|
| 1,106,005 | 8/1914 | Shevlin | 493/94 X |
| 1,991,640 | 2/1935 | Taylor . | |
| 2,038,774 | 4/1936 | Trew . | |
| 2,305,371 | 12/1942 | Yates . | |
| 2,364,943 | 12/1944 | Brandt | 220/495.06 |
| 3,648,882 | 3/1972 | Shelton . | |
| 4,102,376 | 7/1978 | Sharp . | |
| 4,139,119 | 2/1979 | McLaren . | |
| 4,421,253 | 12/1983 | Croley . | |
| 4,558,801 | 12/1985 | Vilutis . | |
| 4,890,652 | 1/1990 | Hoerner . | |
| 4,979,547 | 12/1990 | Hoerner . | |
| 5,108,195 | 4/1992 | Perron . | |
| 5,305,909 | 4/1994 | Merritt . | |

*Primary Examiner*—Jacob K. Ackun
*Attorney, Agent, or Firm*—Cook, Alex, McFarron, Manzo, Cummings & Mehler

[57] ABSTRACT

An easily removed sleeve is provided for use within bulk containers of viscous product such as fruit fillings and fruit chunks. The sleeve has an open bottom and an inside surface which, when used, is positioned between the product and the sidewall of the container. The sleeve is readily removable from between the container and the viscous product by simple grasping and pulling by hand.

25 Claims, 1 Drawing Sheet

EASILY REMOVED SLEEVE AND BULK CONTAINERS AND METHOD INCORPORATING SAME

BACKGROUND OF THE INVENTION

This invention generally relates to bulk packaging of viscous products. More particularly, a sleeve is designed and positioned so as to be easily removed from a bulk container of viscous product. The liner, when inserted into the bulk container of viscous pumpable product, advantageously seals the product without presenting obstacles to removal of the product from the container.

In the past, it has been known to incorporate flexible bags as liners for large containers of bulk-packaged viscous products, including those which are pumpable. These liners are interposed between the viscous product and the inside walls of the container. Such liners completely surround the product being containerized to thereby completely line the container and seal the pumpable product within the liner or bag. While this approach effectively seals the viscous product within the bag and thus within the large container, difficulties have been encountered in removing the pumpable viscous product from the large container.

In many applications, the user of the pumpable product needs to remove the product from the large container without having to lift the container or ladle the product out of the container and into the equipment or location at which the pumpable product is to be put into use. One example in this regard is in whosesale baking applications where a pumpable product such as a fruit filling needs to be added into a product being baked. Whether the pumpable product is transported directly from a large container to the application site or whether it is moved into a hopper or storage tank, efficiencies are realized when such transporting is accomplished by pumping.

When the pumping approach is used, it is typical to insert a pumping tube into the large container of pumpable product. Pumping activity by known means then transports a flow of the pumpable product out of the large container and to the desired location on the processing line, for example. It has been observed that the full liners currently used to effectively seal the pumpable product within the large container can interfere with this needed pumping action. The full liner has a tendency to be drawn into the inlet of the pumping tube, thereby interfering with product flow and potentially damaging or reducing the quality of the pumpable product. If the liner is drawn into the pumping feed tube positioned within the large container, it can continue downstream and potentially damage or interface with proper operation of the equipment on the processing line. At the very least, this type of liner interference will result in a temporary interruption of product flow.

Other approaches for lining large containers shave incorporated lining structures which are secured to the walls of the large container. Such an overall approach has the important disadvantage of making it difficult, if not impossible, to easily remove the liner so that same will not provide even a potential for interference with efforts to remove the product from the large container.

Liners are provided in these types of situations primarily in order to maintain the integrity and freshness of the product packaged within the container. In approaches such as those generally discussed above, the liner has the potential to become a detriment to removal of the product from the container by the end user. Accordingly, an approach is needed which will directly address concerns regarding potential detrimental aspects of liners while still incorporating the use of a liner which is efficient; effective and inexpensive. Any such approach must not compromise the product safety and wholesomeness associated with full bag liners in industries which sell and use pumpable products in large containers.

SUMMARY OF THE INVENTION

In accordance with the present invention, an easily removed sleeve is incorporated into a bulk container, and pumpable viscous product is sealed within the container with the assistance of the sleeve. When the user wishes to remove the pumpable product from the bulk container, the sleeve is readily grasped and pulled out of the container without requiring modification or manipulation of the sleeve prior to pulling it out of the container in order to gain access to the pumpable product. The sleeve is made of polymeric sheeting in a generally cylindrical shape and has an open bottom and a closeable top portion. In use, the bottom surface of the pumpable product rests on the bottom wall of the bulk container, and the height of the sleeve is such that it is readily removable from between the side wall of the bulk container and the pumpable viscous product.

It is accordingly a general object of the present invention to provide improved easily removable sleeving, bulk containers incorporating same, and a method using the sleeve.

Another object of the present invention is to provide an improved combination of a bulk-sized container, a pumpable product, and an easily removable sleeve positioned between the container and the product in a manner which still permits contact between the product and the container at its bottom or a lower location of the container.

Another object of this invention is to provide an improved method for bulk packaging of viscous, pumpable products and for removing the products from the bulk packaging without interference from a liner component.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein.

DESCRIPTION OF THE PREFERRED EMBODIMENTS

Figure 1:
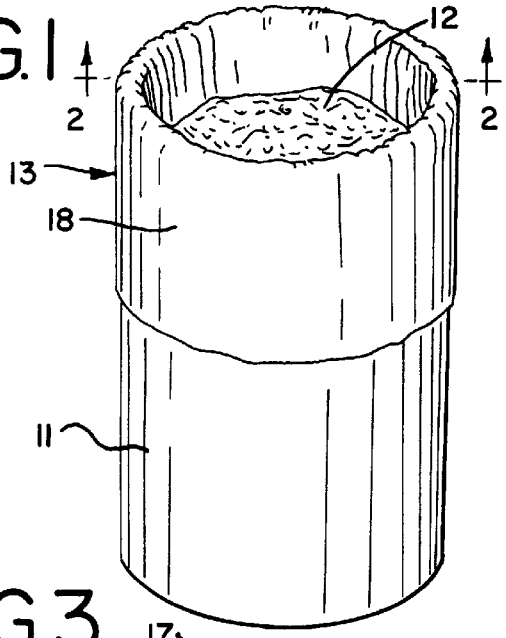
FIG. 1 is a perspective view illustrating a typical embodiment of the invention during a filling stage of the method.

A typical bulk-sized container 11 is illustrated in FIG. 1 and other drawings. Bulk containers include barrels, drums, pails and the like. Often, these products are sold by weight, typically between about 50 pounds and about 1000 pounds (or between about 20 kilograms and about 450 kilograms). In terms of volume, same can range between about 5 gallons and about 100 gallons (between about 19 liters and about 380 liters). Generally these containers will be cylindrical and will be made of any suitable material, including metal, pressboard, paperboard, cardboard, formed self-supporting polymers, and the like.

Figure 3:
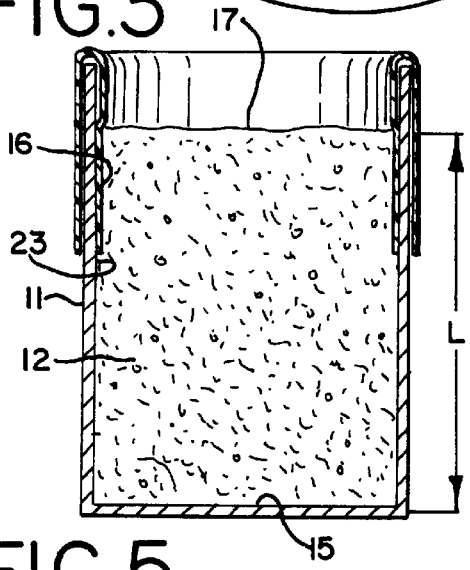
FIG. 3 is a cross-sectional view similar to FIG. 2 after product has been filled.
Figure 4:
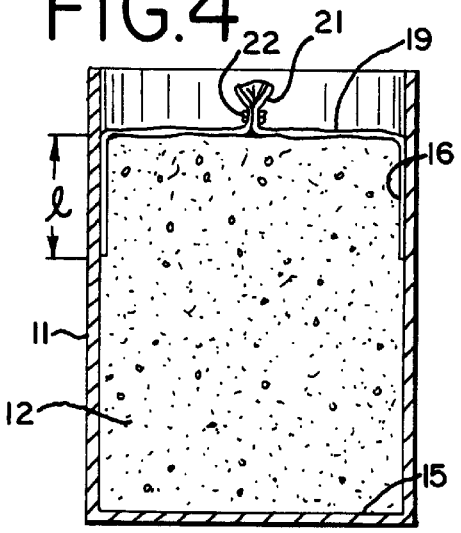
FIG. 4 is a cross-sectional view showing the embodiment of FIG. 3 after closure of the top portion of the easily removable sleeve.
Figure 5:
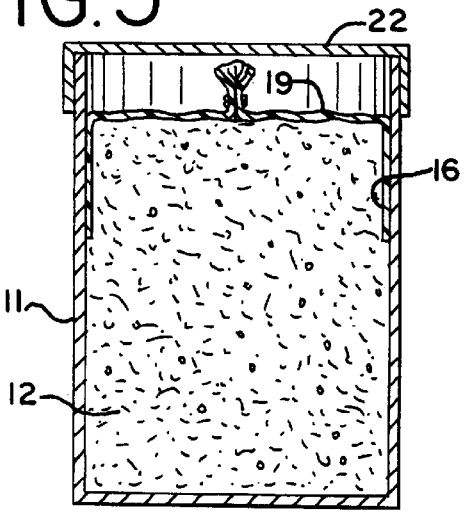
FIG. 5 is a cross-sectional view which illustrates a subsequent step in accordance with the invention after a container lid is positioned into place.

Product 12 is shown as it is filled into the container, as is evident in FIG. 3, FIG. 4 and FIG. 5. Product 12 is a type of product which has a high density and is highly viscous. These include relatively thick products such as fruit fillings, fruit pieces, shortenings, vegetables, soup concentrates, viscous creams and other formulations for cosmetics, personal care products, foods and the like. In this regard, the invention is not particularly suitable for products having relatively low viscosity, such as edible oils. The product should be dense, viscous and thick enough so that it will take on the shape of the container and will tend to maintain that shape once settled into place within the container. The product material must have the capability of maintaining that shape without substantial disruption when the filled container is moved from location to location. As will be better understood from the discussion elsewhere herein concerning the sleeve component, product 12 also performs a function of supporting the sleeve once the sleeve is positioned in place and once its top portion is closed.

Figure 2:
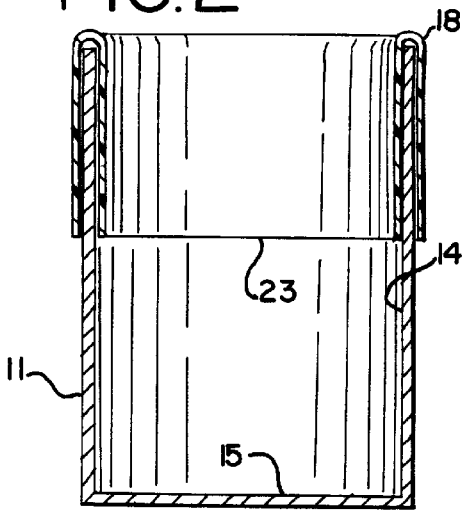
FIG. 2 is a cross-sectional view illustrating the invention prior to filling of pumpable product.

Easily removable sleeve 13 is illustrated in the drawings. In FIG. 2, a generally cylindrical sleeve is shown draped over the sidewall 14 of the container. In this particular illustrated embodiment, the sleeve engages only the upper portion of the inside surface of the sidewall 14. The most desirable length of the inside portion of the sleeve, or inside sleeve surface 16, will depend upon the actual product to be filled within the container. To a somewhat lesser extent, the material and sidewall height of the container 11 will also vary the most desirable length of the inside sleeve surface 16.

With more particular reference to the inside length of the sleeve, its length "l" (FIG. 4) is defined as being between the upper surface 17 of the product 12 and the bottom edge of the sleeve 13. This length "l" can be as short as on the order of one foot to as long as the maximum illustrated length "L" which extends between the upper surface 17 of the product and the bottom surface of the product, which substantially corresponds to the bottom wall 15 of the container. The sleeve inside length "l" needs to be sufficient so that the closed sleeve will remain in place during normal handling. This inside sleeve length should not be so long as to interfere with easy removal of the sleeve, as generally discussed elsewhere herein.

It will be appreciated that the viscosity, density and/or thickness of the product 12 is of primary significance in selecting the most appropriate inside sleeve length "l". A very viscous product will maintain its shape more readily on its own than will a less viscous product, requiring a shorter length to maintain the sleeve in place. In addition, it is at least as important to have a shorter length inside sleeve surface 16 when the product is very viscous in order to allow the sleeve 13 to be easily removable. Conversely, when a viscous product which has a relatively lower viscosity is filled into the container 11, it will be less likely to strictly maintain its shape on its own during handling of the filled container, thereby necessitating a longer inside sleeve surface 16. Also, because the somewhat less viscous product will more easily release from the sleeve when the sleeve is pulled upwardly (see FIG. 6), this type of product will permit a longer inside sleeve surface 16. Generally, for many types of products, the inside sleeve surface length "l" will range between about ⅓ and about ⅔ of the length "L", both lengths being measured from the upper surface 17 of the product 12.

Easy release sleeve 13 further includes a closeable top portion 18. This is the portion of the sleeve 13 which is above or otherwise not contacted by the product 12 when the sleeve is in the open condition which is shown in FIGS. 1, 2 and 3. This closeable top portion 18 is easily manipulated to form the sealed sleeve top 19 which is visible in FIG. 4 and FIG. 5. Sealed sleeve top 19 is formed by folding over the closeable top portion 18 and pushing it down onto the top surface 17 of the product. Once thus positioned in contact with the top surface 17, this portion of the sleeve 13 is manipulated so as to form gathered seal 21. Gathered seal 21 may be formed by tying a knot in a central gathered portion of the closeable top portion 18 or by inserting or wrapping a tying device 22 around the gathered portion. Whatever approach is used, the sealed sleeve top 19 is secured over the top surface 17 of the product in a manner which eliminates any headspace between the sleeve 13 and the product 12.

Preferably, prior to forming the sealed sleeve top 19, a bacterial inhibitor or the like is sprayed or otherwise placed onto at least top surface 17 of the product. Such inhibitors are generally known in the art and are intended to perform functions such as inhibition of fungus, mold, yeast and bacteria in general. Examples of these types of bacterial inhibitors include food grade acids such as propionic acid, paraben compounds such as Parabencil™, Parabis™ and the like, as well as sorbates. It will be appreciated that the particular inhibitor or inhibitors selected will be appropriate for the particular product being containerized. A lid 22 will typically be positioned over the open end or mouth of the container so as to provide physical protection for the liner and product during handling, transporting and storage of the closed container.

Figure 6:
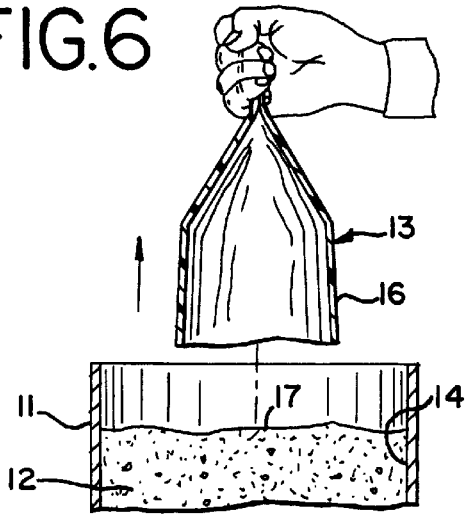
FIG. 6 is a partial cross-sectional view illustrating the invention after easy sleeve removal has been accomplished.

FIG. 6 illustrates the easy removal aspect of the invention. Digital grasping and pulling of the sleeve away from the mouth of the container, typically in an upward direction as illustrated, easily removes the sleeve 13. This is accomplished through the use of ordinary digital grasping and pulling forces. The magnitude of these forces is adjusted by selecting an inside sleeve surface length "l" which will readily slide out of its location between the product and the sidewall 14 upon the application of a grasping and pulling force which can be provided by the hand of a line worker of average strength and dexterity. Once the sleeve 13 is thus removed, the user has access to the product 12. It will be noted that this access allows for insertion of a vacuum tube into the product and removal of the product without any interference whatsoever by the sleeve, which has been completely removed from the container.

With more particular reference to the sleeve 13, this can take the form of a right cylinder of polymeric sheeting. When thus embodied, the cylinder has an outside diameter which equals or closely approximates the inside diameter of the container 11 and of its cylindrical inside sidewall 14. Sleeve 13 has a closeable top portion 18 which has a height or length (the dimension perpendicular to its diameter) which leaves an inside sleeve surface 16 having length "l" as discussed herein. It will be appreciated that the sleeve has an open bottom. The extent of the length "l", and the size and location of the open bottom of the sleeve will depend primarily upon the identity and consistency of the product.

The sleeve can be made of any suitable material for contact with the particular product being containerized and stored. In most instances, polyolefins are adequate, examples being high density polyethylene, low density polyethylene, polypropylene and the like. A typical wall thickness of the sleeve will range between about 1 mil and about 10 mils (between about 0.0254 mm and about 0.254 mm). Whatever material and thickness are utilized, the sleeve must be flexible enough to be closed as discussed herein and must be strong enough such that the mass of the product will not tear the sleeve during storage, transport and sleeve removal. Preferably, the sleeve is substantially transparent so that the user can observe the top surface of the product without disturbing the sealed sleeve and without exposing the product to air. It will further be noted that, with the present invention, there is no requirement to seal any portion of the sleeve to any container wall.

It will be understood that the embodiments of the present invention which have been described are illustrative of some of the applications of the principles of the present invention. Various modifications may be made by those skilled in the art without departing from the true spirit and scope of the invention.

I claim:

1. A bulk packaged viscous product, comprising:

a bulk-sized generally cylindrical large container having a sidewall, a bottom wall, and a top opening, said sidewall having a predetermined height;

a bulk quantity of viscous, pumpable product within said generally cylindrical large container, said viscous product being shaped by the container so as to have a generally cylindrical surface of a given height, a bottom surface, and a top surface;

a generally cylindrical sleeve of flexible and strong polymeric sheeting, said sleeve having an inside surface which is positioned between at least a portion of said sidewall of the container and at least said cylindrical surface of the viscous product, said sleeve having an open bottom whereby said bottom surface of the viscous product directly contacts said bottom wall of the container, said sleeve having a closeable top portion which engages said top surface of the viscous product when said closeable top portion is closed; and said sleeve which has said open bottom is readily removable from between said container and said viscous product by digital grasping of and pulling on said top portion of the sleeve without requiring any modification of the sleeve prior to such removal.

2. The bulk-packaged viscous product in accordance with claim 1, wherein said inside surface of the sleeve has a length which is not greater than said given height of the bulk quantity of viscous product.

3. The bulk-packaged viscous product in accordance with claim 1, wherein said inside surface of the sleeve has a length of at least about one foot (about 30.5 cm), and said length is between the top surface of the viscous product and a bottom edge of the sleeve, said sleeve length being defined in a direction generally perpendicular to the diameter of the sleeve.

4. The bulk-packaged viscous product in accordance with claim 1, wherein said inside surface of the sleeve has a length demarcated in part by the top surface of the viscous product, said length being defined in an orientation generally perpendicular to the diameter of the viscous product, said length being between about one foot (about 30.5 cm) and about said given height of the viscous product.

5. The bulk-packaged viscous product in accordance with claim 1, wherein said top portion of the sleeve is a sealed sleeve top having a gathered seal, said sealed sleeve top being in engagement with the top surface of the viscous product.

6. The bulk-packaged viscous product in accordance with claim 1, wherein said container has a capacity of between about 5 gallons and about 100 gallons (between about 19 liters and about 380 liters).

7. The bulk-packaged viscous product in accordance with claim 1, wherein said viscous product is a fruit-containing product.

8. The bulk-packaged viscous product in accordance with claim 1, wherein said open bottom of the sleeve does not engage the bottom wall of the container.

9. The bulk-packaged viscous product in accordance with claim 8, wherein said open bottom of the sleeve is spaced away from the bottom wall of the container such that said inside surface of the sleeve has an inside length which extends from the top surface of the viscous product to a bottom edge of the sleeve, said inside length being between about ⅓ and about ⅔ of said given height of the viscous product.

10. A sleeve and a bulk-packaged viscous product, comprising:

a generally cylindrical sleeve of flexible and strong polymeric sheeting;

a bulk quantity of a viscous product which is shaped so as to have a sidewall surface of a given height, a bottom surface and a top surface;

said generally cylindrical sleeve has an inside surface which is positioned over less than the entirety of said given height of the sidewall surface of the viscous product, said sleeve having an open bottom whereby the sleeve does not engage the bottom surface of the viscous product, said sleeve having a closeable top portion which is adapted to engage the top surface of the viscous product when the closeable top portion is closed; and said sleeve which has said open bottom is adapted to be readily removable from the viscous product by digital grasping of and pulling on said top portion of the sleeve without requiring any modification of the sleeve prior to such removal.

11. The sleeve and product in accordance with claim 10, wherein said inside surface of the sleeve has a length which is not greater than said given height of the bulk quantity of viscous product.

12. The sleeve and product in accordance with claim 10, wherein said inside surface of the sleeve has a length demarcated in part by the top surface of the viscous product, said length being defined in an orientation generally perpendicular to the diameter of the viscous product, said length being between about one foot (about 30.5 cm) and about said given height of the viscous product.

13. The sleeve and product in accordance with claim 10, wherein said closeable top portion of the sleeve together onto itself and is adapted to close closely onto the top surface of the viscous product.

14. A method for packaging a viscous pumpable product in bulk, comprising the steps of:

providing a bulk-sized, generally cylindrical large container having a sidewall, a bottom wall and a top opening;

inserting into the bulk-sized container a generally cylindrical sleeve of flexible and strong polymeric sheeting which has a sidewall, and open bottom and a closeable top portion;

filling the bulk-sized container with a bulk quantity of viscous product until at least a portion of the sidewall of the sleeve is positioned between at least a portion of the container sidewall and of the viscous product; and closing the closeable top portion of the sleeve such that the closeable top portion of the sleeve engages the top of the viscous product defined after the filling step in order to remove any head space between the sleeve and the viscous product.

15. The method in accordance with claim 14, further including positioning a lid onto the container so as to close the top opening of the container.

16. The method in accordance with claim 14, wherein said inserting and filling steps are combined to position the open bottom of the sleeve adjacent to the bottom wall of the container.

17. The method in accordance with claim 14, wherein said inserting and filling steps are combined to position the open bottom of the sleeve so as to be spaced from the bottom wall of the container.

18. The method in accordance with claim 14, wherein said inserting and filling steps combine to position the sleeve such that an inside surface thereof engages a cylindrical sidewall of the viscous product which has a height determined by said filling step, and the length of the inside sleeve surface is not greater than said determined height of the viscous product.

19. The method in accordance with claim 14, wherein said inserting and filling steps combine to position the sleeve such that an inside surface thereof engages a cylindrical sidewall of the viscous product which has a height determined by said filling step, the length of the inside sleeve surface is not greater than said determined height of the viscous product, and the inside surface of the sleeve has a length of at least about one foot (about 30.5 cm).

20. A method for packaging a viscous pumpable product in bulk by use a sleeve and then for accessing the viscous pumpable product by removing sleeve, the method comprising the steps of:

providing a bulk-sized, generally cylindrical large container having a sidewall, a bottom wall and a top opening;

inserting into the bulk-sized container a generally cylindrical sleeve of flexible and strong polymeric sheeting which has a sidewall, and open bottom and a closeable top portion;

filling the bulk-sized container with a bulk quantity of viscous product until at least a portion of the sidewall of the sleeve is positioned between at least a portion of the container sidewall and of the viscous product;

closing the closeable top portion of the sleeve such that the closeable top portion of the sleeve engages the top of the viscous product defined after the filling step in order to remove any head space between the sleeve and the viscous product; and removing the sleeve from the container by grasping the closed top portion of the sleeve and pulling the sleeve out of the container through its top opening, said removing step being accomplished without requiring modification of the sleeve between said closing step and said removing step.

21. The method in accordance with claim 20, further including positioning a lid onto the container so as to close the top opening of the container after said closing step, and taking the lid off of the container prior to said removing step.

22. The method in accordance with claim 20, wherein said inserting and filling steps are combined to position the open bottom of the sleeve adjacent to the bottom wall of the container.

23. The method in accordance with claim 20, wherein said inserting and filling steps are combined to position the open bottom of the sleeve so as to be spaced from the bottom wall of the container.

24. The method in accordance with claim 20, wherein said inserting and filling steps combine to position the sleeve such that an inside surface thereof engages a cylindrical sidewall of the viscous product which has a height determined by said filling step, and the length of the inside sleeve surface is not greater than said determined height of the viscous product.

25. The method in accordance with claim 20, wherein said inserting and filling steps combine to position the sleeve such that an inside surface thereof engages a cylindrical sidewall of the viscous product which has a height determined by said filling step, the length of the inside sleeve surface is not greater than said determined height of the viscous product, and the inside surface of the sleeve has a length of at least about one foot (about 30.5 cm).

* * * * *

UNITED STATES PATENT AND TRADEMARK OFFICE

CERTIFICATE OF CORRECTION

PATENT NO : 5,979,650

DATED : November 9, 1999

INVENTOR(S) : Bob J. Dull

It is certified that error appears in the above-identified patent and that said Letters Patent are hereby corrected as shown below:

Col. 1, line 30, delete "whosesale" and insert --wholesale--.
Col. 1, line 54, delete "shave" and insert --have--.
Col. 6, line 56, insert --gathers-- after "sleeve".
Col. 7, line 37 insert --of-- after "use".
Col. 7, line 38 insert -the-- after "removing".

Signed and Sealed this

Tenth Day of April, 2001

*Attest:*

Nicholas P. Godici

NICHOLAS P. GODICI

*Attesting Officer*

*Acting Director of the United States Patent and Trademark Office*